US006275194B1

(12) United States Patent
Ansorge

(10) Patent No.: US 6,275,194 B1
(45) Date of Patent: Aug. 14, 2001

(54) ANTENNA SYSTEM FOR A TELEPHONE IN A VEHICLE

(75) Inventor: Christian Ansorge, Ulm (DE)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/575,441

(22) Filed: May 22, 2000

(30) Foreign Application Priority Data

May 22, 1999 (DE) ..... 199 23 661

(51) Int. Cl.[7] ..... H01Q 1/32
(52) U.S. Cl. ..... 343/713; 343/715; 343/876
(58) Field of Search ..... 343/713, 715, 343/711, 712, 702, 906, 876; H01Q 1/32

(56) References Cited

U.S. PATENT DOCUMENTS 5,714,959 * 2/1998 Troy et al. ..... 343/713

FOREIGN PATENT DOCUMENTS 2546260 10/1975 (DE) .
19719657 5/1997 (DE) .
19752189 11/1997 (DE) .
0859237 8/1998 (DE) .

* cited by examiner

*Primary Examiner*—Michael C. Wimer
(74) *Attorney, Agent, or Firm*—Antonelli, Terry, Stout & Kraus, LLP

(57) ABSTRACT

An antenna system for a radio telephone in a vehicle that has a primary antenna to realize telephone communication with optimal connection quality connected to the radio telephone by an antenna wire, a secondary antenna that at least allows for telephone communication with limited connection quality when the primary antenna fails and an electric switch that connects the secondary antenna to the radio telephone after the primary antenna fails. This is realized in that the primary antenna is mounted on the vehicle with a breakable fastening element and that the switch automatically connects the secondary antenna to the antenna wire by mechanical means in place of the primary antenna when the fastening element is broken off.

12 Claims, 2 Drawing Sheets

ANTENNA SYSTEM FOR A TELEPHONE IN A VEHICLE

BACKGROUND OF THE INVENTION

Antenna system for a radio telephone in a vehicle that has a primary antenna to realize telephone communication with optimal connection quality and a secondary antenna that will at least allow telephone communication with lower connection quality when the primary antenna becomes damaged. The primary antenna is advantageously located on the outside of the vehicle, e.g. on the surface of the body of the vehicle or near the window, which provides a higher level of performance for sending as well as for receiving, but which can lead to complete failure if the vehicle is involved in an accident. The secondary antenna serves as an emergency antenna after the failure of the primary antenna, the main antenna, especially after an accident, to establish a telephone connection in order to call for help. As a radio telephone is only ready for operation when all of its components are functioning properly and an antenna is particularly sensitive mechanically when placed on the exterior of a vehicle, the solution according to the invention significantly increases the reliability of a radio telephone in an emergency. The application of the invention is not limited to conventional radio telephones with one operating frequency band. The invention can also be applied to antennas utilizing various operating frequency bands for mobile communication.

Car phones are usually equipped with an external or window antenna. The location of this antenna is primarily determined by the requirements that need to be met to achieve optimal sending and receiving quality.

One disadvantage of selecting such a location is that the probability of damaging the antenna to the point of total failure is high when the vehicle is involved in an accident or when other external forces act on the antenna. In particular, these other external forces acting on external antennas include, for example, the intentional destruction of the antenna by a stranger or the breaking off of the antenna while passing under an obstacle with low clearance. It is not possible to establish a radio telephone connection to call for help after a traffic accident or vehicle malfunction, for example, after the total failure of the antenna.

To eliminate this shortcoming an emergency or back-up antenna is installed in a protected location such as the passenger compartment of the vehicle as stated in publication EP-A1-0 859 237. This secondary antenna is then used for sending/receiving operations after the external antenna used as the main antenna fails. Each antenna is connected to the radio telephone via a separate coaxial cable. The radio telephone has two separate antenna connections for this purpose.

To obtain the maximum transmission quality and to prevent interference during normal send/receive operations, the emergency antenna is not to be used while the main antenna is functioning. This means that the emergency antenna and the corresponding wire are only to be put into operation in an emergency by the manual or automatic initiation of an emergency call. To accomplish this, an emergency call button is activated or the air bag and/or seat belt mechanism controller sends a corresponding control signal to the radio telephone when triggered to switch the radio telephone to the secondary antenna connection.

In principle, there are various solutions used to switch the radio telephone to the emergency antenna:

In simple solutions, the initiation of an emergency call in the radio telephone will automatically force the radio telephone to switch to the connection for the emergency antenna regardless of whether or not the main antenna is still operational. One requirement for this to occur is that there must be a high probability that the emergency antenna and its separate antenna wire still function due to installation in a protected location.

However, malfunctions or damage to the antenna feed cable leading to the emergency antenna can arise when connecting the antenna or operating the vehicle that remain undetected because the emergency antenna is not used during normal operation. Under certain circumstances, this antenna may not function properly in an emergency. Additionally, its efficiency is generally lower that that of the main antenna due to its installation location. This may also lead to the inability to connect to the base station using the less powerful emergency antenna when the vehicle is in an unfavorable position although the connection could be made using an intact main antenna.

To avoid this shortcoming, radio telephones with several antenna connections and other accessories periodically perform a test procedure in which the antennas are operated alternately and checked to see if they are functioning properly. This can be done, for example, by comparing the signal strength of the signal received or, in accordance with publication EP 0 859 237 A1, by comparing the signal strengths of the signal supplied and the signal reflected back by the antenna wire.

In this manner, malfunctions and damage to the antennas and the wires will be detected and indicated, and the unit can quickly switch to a functioning branch of the antenna. The test procedure is also generally performed when an emergency call is triggered so that the unit only switches to the less powerful emergency antenna when the main antenna has failed due to breakage, for example.

However, one disadvantage of these two solutions is that the radio telephone requires several antenna connections for the separate branches of the antennas and that an antenna feed cable must be installed for each antenna. In addition, the radio telephone must have special test circuitry to automatically perform the test procedure in the latter solution. The requirements stated therefore result in additional undesired complexity.

An antenna switching circuit to selectively use the internal or external antenna of a radio telephone is known from publication DE 197 19 657 A1. In contrast to the solution according to the invention, the internal antenna is an antenna that is built into the radio telephone and the external antenna is an automobile antenna that is connected manually to the radio telephone via a flexible feed cable and an antenna connector plug. A switching device on the HF module of the radio telephone disconnects the internal antenna from the module and connects the radio telephone to a vehicle antenna as soon as the antenna connector plug is inserted into a radio telephone socket equipped with contact springs. The contact springs of the socket form a switch that supplies the switching unit with a corresponding control voltage. The known solution only allows for the manual changing of antenna connections. There is no automatic switching performed in an emergency.

Based on the shortcomings of the known solutions, it is the task of the invention to create an antenna system with several antennas for a radio telephone in a vehicle in which, with little or no effort, the unit only switches to an emergency antenna when the main antenna is not present any more.

SUMMARY OF THE INVENTION

The task of the invention is accomplished for a radio telephone by alternately operating the primary and secondary antenna over the same antenna wire and by operating a switch near the primary antenna that is activated when the primary antenna is missing in order to connect the secondary antenna to the antenna wire. To do this, the primary antenna is mounted on the vehicle on a holder with a breakable fastening element and is connected mechanically to a contact spring in the switch. This will hold the contact spring in place under tension in a direction opposite the direction of force of the spring. The secondary antenna is connected to a contact element that forms the opposing contact for the tensed contact spring. The primary antenna is advantageously manufactured using an unbreakable material while the fastening element is made of a material with a lower breaking strength. Alternatively, the fastening element could also be designed so that it has a breaking point. This breaking point will cause the antenna to break off near the holder when an unusually high external force acts on the antenna, for example when the vehicle rolls over. The contact spring is mounted in the holder such that when the antenna breaks off or is removed, the contact spring is released and the secondary antenna is connected to the radio telephone instead of the primary antenna.

The invention will be explained in more detail using the following examples and drawings. The corresponding drawings show cross-sectional diagrams of:

DETAILED DESCRIPTION

Figure 1:
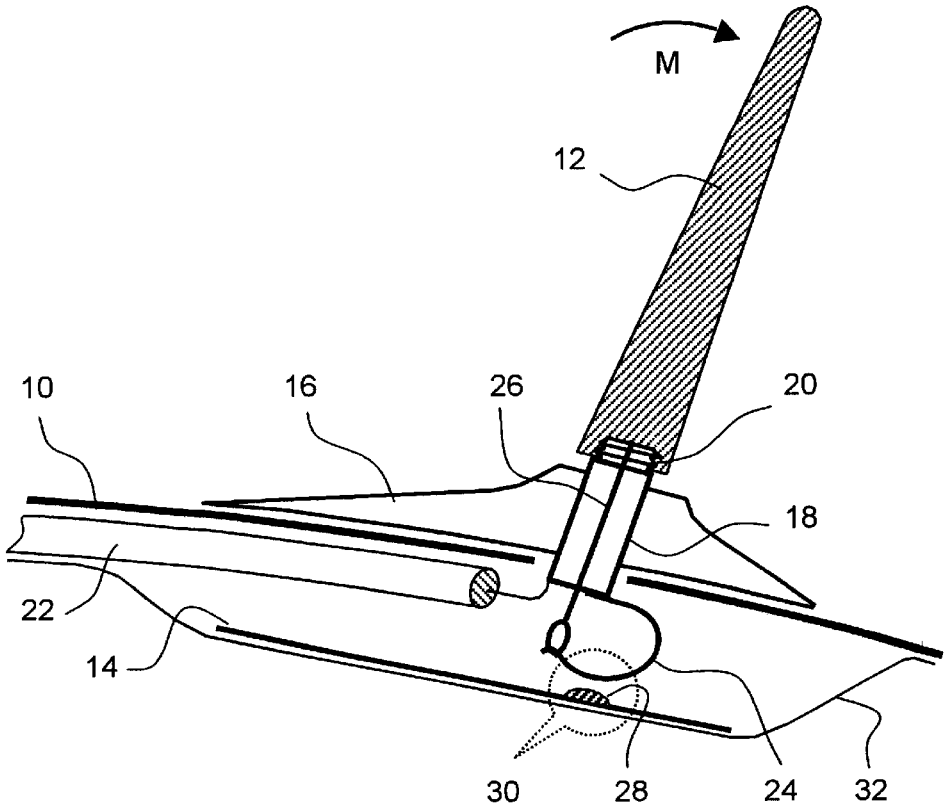
FIG. 1 An initial design of an antenna system for a radio telephone in a vehicle according to the invention in its original functional state FIG. 2 The antenna system according to FIG. 1 after the main antenna has broken off due to an accident, for example FIG. 3 Another design for the antenna system according to the invention in its original functional state FIG. 4 The antenna system according to FIG. 3 with the main antenna not mounted

FIG. 1 shows the cross-sectional diagram of an antenna system for a radio telephone according to an initial design of the invention in its original functional state, i.e. with no mechanical damage to the system.

In the present example a primary antenna 12, in the form of a conventional rod antenna, is mounted externally on the roof of the vehicle 10 or on another part of the vehicle body, and a secondary antenna 14 is mounted under the roof of the vehicle 10. Antenna 12 is fastened to the roof of the vehicle by a holder 16. The holder 16 is, as usual, made of a nonconductive material and contains a breakable fastening element in the form of a hollow cylinder 18 with an externally threaded section 20 onto which the antenna 12 is screwed. The hollow cylinder 18 is either made of metal, at least near the externally threaded section 20, or it contains a conductor that establishes an electrical connection between the antenna 12 and the antenna wire 22. Antenna wire 22 connects the antenna system to the radio telephone.

In this example a mechanical contact spring 24, which can be retracted, is mounted directly on the hollow cylinder 18, which contains a strain relief 26 under tension in the interior of the hollow cylinder 18. The strain relief 26 is advantageously fastened directly to the externally threaded section 20 of the holder. This has the advantage that, on the one hand, the holder 16 can be completely prefabricated as a module together with the hollow cylinder 18, the contact spring 24 and the strain relief 26. On the other hand, the antenna 12 can be temporarily removed without any problems when going through a car wash, for example, without having to release contact spring 24.

Figure 3:
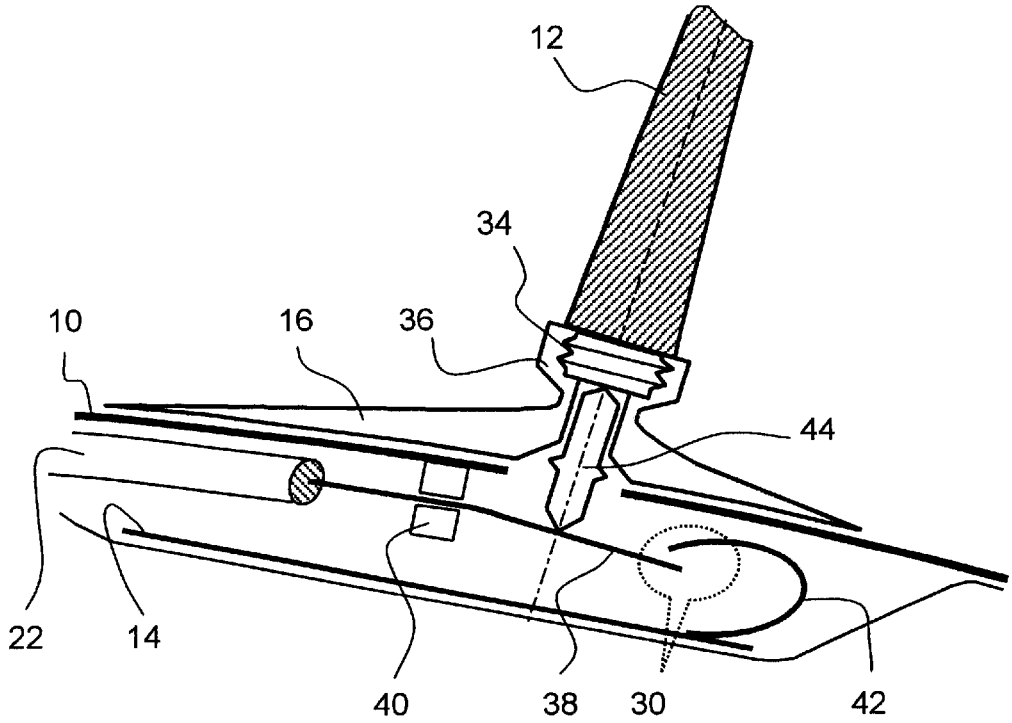

The hollow cylinder 18 is designed mechanically so that it breaks instead of the body of the antenna when antenna 12 is subject to extreme mechanical stress such as the stress resulting from the bending moment M shown, for example. To accomplish this, antenna 12 is advantageously made of conductive rubber or elastic metal, and the hollow cylinder 18 is made of rigid metal or rigid plastic. The fastening element can also be a direct part of the holder 16 as shown in FIG. 3 and can have a breaking point in the form of a reduced cross-sectional area of material at that point.

The antenna 14, which is designed as a sheet antenna, for example, and which is mounted directly under antenna 12 in the interior of the vehicle, has a contact element 28. Together with the contact spring 24, this forms a switch 30 that is held open in its normal operating state by the strain relief 26. The entire interior part of the antenna system is embedded together with the end of the antenna wire 22 that is connected to the antenna in an insulated housing 24 in the body panel of the roof of the vehicle 10 so that when the roof of the vehicle 10 has sufficient mechanical stability, the danger of destroying the antenna is very low even if an accident occurs.

Figure 2:
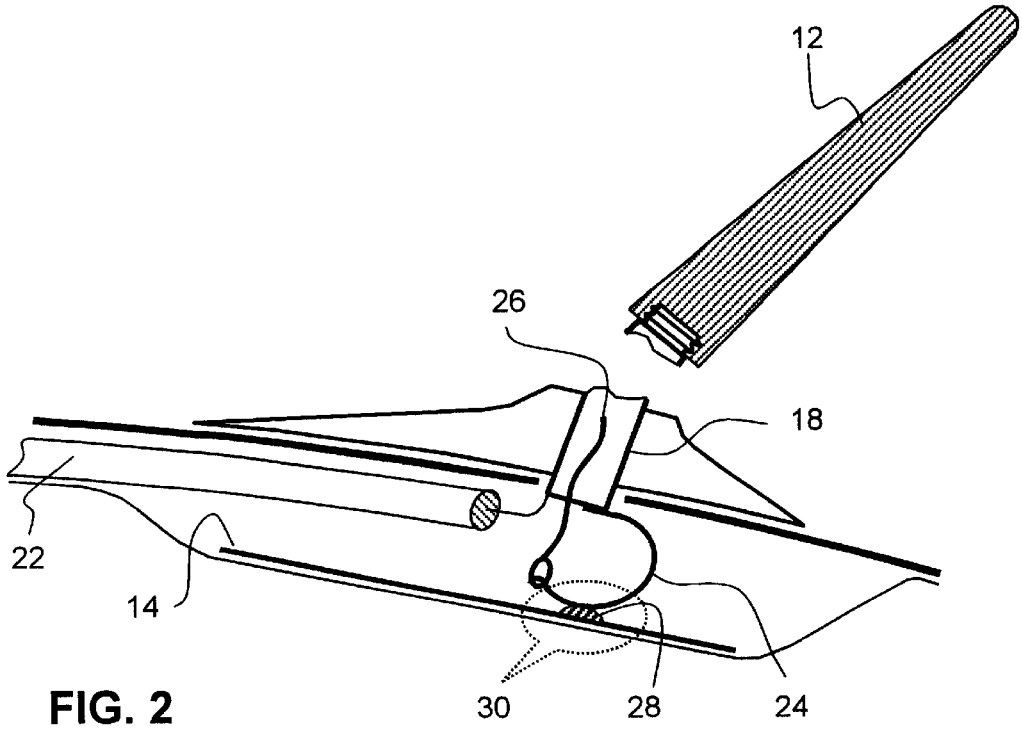

FIG. 2 shows the system according to the first example in the destroyed state, i.e. after the antenna 12 has broken off near the hollow cylinder 18. When the hollow cylinder 18 is broken and the antenna 12 correspondingly fails, the externally threaded section 20 of the hollow cylinder 18 remains inside of the antenna 12. At the same time, the strain relief 26 tears or breaks off and releases the tension on the contact spring 24. The spring releases and then makes contact with the contact element 28. This causes switch 30 to establish a connection between antenna wire 22 and antenna 14, and this antenna is used automatically instead of the failed antenna 12.

In the present design example, antenna 14 is advantageously designed as a printed circuit board. The contact element 28 is an electroplated contact surface on the surface of the circuit board. In another design according to the invention, the antenna 14 can be mounted at a different location in the vehicle and can be connected to the contact element 28 via an additional antenna wire.

In another design according to the invention, an antenna used for a different type of signal, for example for receiving AM/FM radio or satellite navigation signals, can be used for antenna 14 instead of an additional antenna for the radio telephone. In this case the selection circuit for separating the frequency bands can be advantageously placed on the surface of the circuit board.

Figure 4:
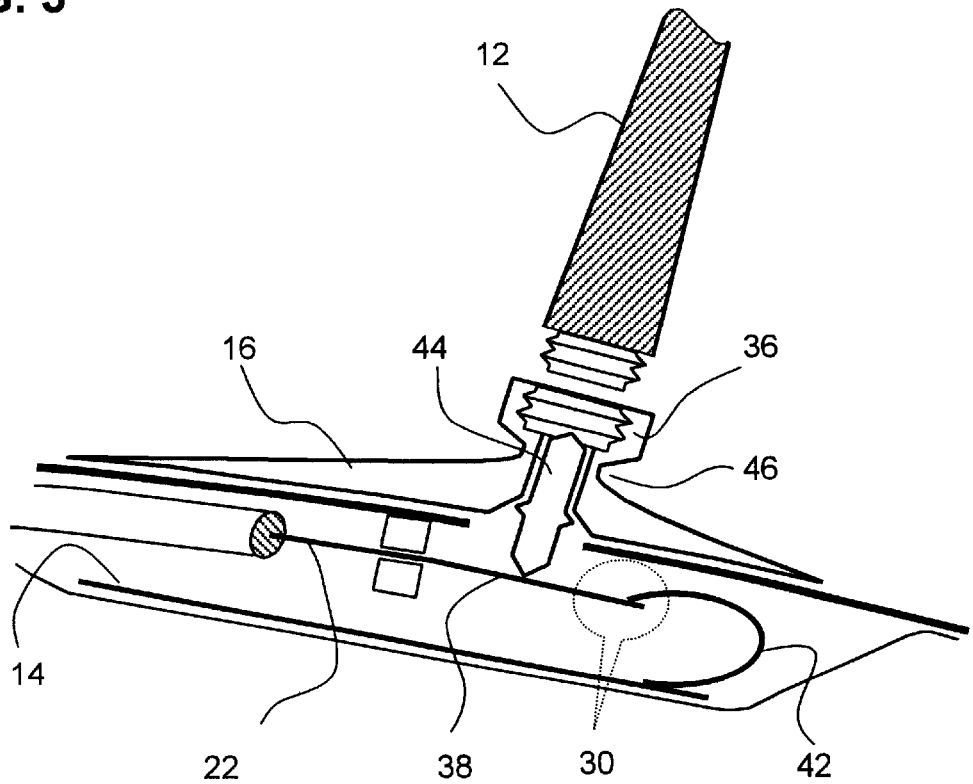

FIG. 3 and FIG. 4 show another type of design of the invention. This design has the additional advantage that the antenna system switches to antenna 14 even when antenna 12 has only been unscrewed and removed. This feature allows one to make an emergency call even if antenna 12 was stolen or forgotten.

In the solution according to FIGS. 3 and 4, the primary antenna 12 is also mounted as a rod antenna on the roof of the vehicle 10, and the secondary antenna 14 is mounted under the roof of the vehicle 10. The antenna 12 is fastened to the roof of the vehicle 10 using the holder 16. The antenna 12 and the holder 16 are different from those in the first solution in that the antenna 12 has an externally threaded section 34 that screws into the threaded head 36 of the holder 16. An elongated contact blade spring 38 that reacts to pressure and that is clamped at one end in a holder 40 is used instead of the retractable contact spring 22. In this case there is a bent contact element 42 connected to the antenna 14, which is formed as a sheet. The end of this bent contact is placed within the range of motion of the movable end of the contact blade spring 38. In this design, the contact element 42 and the contact blade spring 38 form switch 30.

There is an electrically conductive, vertically adjustable contact pin 44 placed in the holder 16 instead of the strain relief 26 in the hollow cylinder 18 from FIG. 1. This pin forms the electric connection between antenna 12 and the antenna wire 22 and in doing so presses, as shown in FIG. 3, the contact blade spring 38 and the contact element 42 apart when the antenna system is in its original functional state. This keeps switch 30 open and antenna 14 disconnected from the antenna wire 22.

FIG. 4 shows the antenna system according to FIG. 3 with antenna 12 removed, for example to drive through a car wash. In this state the contact blade spring 38 is in contact with the contact element 42 because the contact blade spring 38 pushes the contact pin 44 upwards because antenna 12 is missing. Now the antenna 14 is connected to the antenna wire 22 via the contact blade spring 38 and the contact element 42 instead of being connected to the missing antenna 12. This function is makes sense when someone has forgotten to screw the antenna 12 back on or when the antenna has been lost.

In this design the threaded head 36 in conjunction with the breaking point 46, which is located on the holder 16 underneath the threaded head 36, serves as the breakable fastening element for the desired emergency function. The breaking point 46 is formed by significantly reducing the cross-sectional diameter of the material at this location. When an extreme mechanical load is placed on the antenna 12, the holder 16 breaks at the breaking point 46, whereby the antenna 12 remains in the threaded head 36 that was broken off. In doing so, the contact pin 44 moves away from its original position and releases the pressure contact blade spring 38. The antenna 14 is connected to antenna wire 22 so that the emergency call function can be performed.

It must be expressly pointed out that the solution according to the invention allows for numerous variations of the mechanical elements. For example, the contact spring or the contact element could be formed differently or mounted at different locations. The contact pin 44 can also be fixed on one end. Combinations of individual elements from both designs also result in favorable solutions.

What is claimed is:

1. An antenna system for a radio telephone in a vehicle comprising:

a primary antenna used to communicate via telephone with optimal connection quality through an antenna wire connected to the radio telephone;

a secondary antenna that allows one to at least make a telephone call with reduced connection quality when the primary antenna fails; and an electric switch that connects the secondary antenna to the radio telephone after the primary antenna fails, wherein the primary antenna is fastened to the vehicle with a breakable fastening element, and wherein the switch automatically connects the secondary antenna to the antenna wire by mechanical means in place of the primary antenna when the fastening element is broken off.

2. An antenna system according to claim 1, wherein the primary antenna with the breakable fastening element is fastened in a holder and is connected mechanically to a contact spring of the switch to place the spring under tension in the direction opposite the direction of the force of the spring, wherein the secondary antenna is connected to a contact element that forms the switch together with the loaded contact spring, and wherein the contact spring and primary antenna are connected to each other in such a way that the breaking off of the fastening element on the holder or the lack of a primary antenna in the holder will release the contact spring and connect the secondary antenna to the antenna wire instead of the primary antenna.

3. An antenna system according to claim 1, wherein the fastening element is made of a rigid material and the primary antenna is made of an unbreakable material or a material with a high breaking strength so that the fastening element inevitably breaks instead of the primary antenna when a high external force acts on it, thereby causing the electric switch to close.

4. An antenna system according to claim 1, wherein the fastening element is a part of the holder, which breaks at a breaking point when a high external force acts on the primary antenna.

5. An antenna system according to claim 1, wherein the contact element is located inside the vehicle near the fastening element, and wherein the contact spring is connected to the antenna wire leading to the primary antenna.

6. An antenna system according to claim 4, wherein the secondary antenna is designed as a sheet on which the contact element is located.

7. An antenna system according to claim 1, wherein the contact spring is placed under tension using a strain relief that is mounted on a part of the fastening element that is located inside the primary antenna so that the contact spring is only released when the primary antenna is broken off.

8. An antenna system according to claim 1, wherein there is a pressure element located between the primary antenna and the antenna wire that presses the contact spring and the contact element apart as long as the primary antenna is still located in the holder.

9. An antenna system according to claim 1, wherein the secondary antenna is an antenna used by a different radio service that operates in a different frequency band.

10. An antenna system according to claim 9, wherein a selection circuit for separating the frequency bands is combined with the switch.

11. An antenna system according to claim 2, wherein the fastening element is a part of the holder, which breaks at a breaking point when a high external force acts on the primary antenna.

12. An antenna system according to claim 11, wherein the secondary antenna is designed as a sheet on which the contact element is located.

* * * * *